United States Patent [19]

Sadhukhan

[11] Patent Number: 4,551,223

[45] Date of Patent: Nov. 5, 1985

[54] THERMAL FLASHING OF CARBONACEOUS MATERIALS

[75] Inventor: Pasupati Sadhukhan, Katy, Tex.

[73] Assignee: Phillips Petroleum Company, Bartlesville, Okla.

[21] Appl. No.: 590,827

[22] Filed: Mar. 19, 1984

[51] Int. Cl.[4] ..... C10G 1/00

[52] U.S. Cl. ..... 208/8 R; 208/11 R; 585/240; 201/36

[58] Field of Search ..... 208/8 R, 11 R; 585/240; 201/36

[56] References Cited

U.S. PATENT DOCUMENTS

| | | | |
|---|---|---|---|
| 4,234,408 | 11/1980 | Duncan | 208/8 R |
| 4,243,509 | 1/1981 | Sinor | 208/8 R |
| 4,253,836 | 3/1981 | Long | 208/8 R |
| 4,299,685 | 11/1981 | Khulbe et al. | 208/8 R |
| 4,323,538 | 4/1982 | Sinor | 208/8 R |
| 4,383,912 | 5/1983 | Saadi et al. | 208/8 R |
| 4,412,908 | 11/1983 | Yumashita et al. | 208/8 R |
| 4,415,431 | 11/1983 | Matyas et al. | 208/8 R |

FOREIGN PATENT DOCUMENTS

| | | | |
|---|---|---|---|
| 630048 | 11/1949 | United Kingdom | 208/8 R |

*Primary Examiner*—D. E. Gantz
*Assistant Examiner*—Chung K. Pak
*Attorney, Agent, or Firm*—C. F. Steininger

[57] ABSTRACT

A method for thermally flashing gases and liquids from a particle-form, normally solid carbonaceous material, including: contacting the carbonaceous material with a gas, which may supply at least part of the necessary heat, at essentially atmospheric pressure and a temperature and residence time sufficient to maximize the flashing of gases and liquids from the carbonaceous material but insufficient to decompose significant amounts of the flashed gases and liquids. Preferably, the carbonaceous material is entrained in the gas to form an entrained descending body of carbonaceous material in the contact zone. Residual solids containing carbonaceous material may be burned to produce fuel gas or reacted with steam or air and steam to form a synthesis gas and at least part of the flue gas or the synthesis gas utilized as the contact gas.

17 Claims, 4 Drawing Figures

THERMAL FLASHING OF CARBONACEOUS MATERIALS

BACKGROUND OF THE INVENTION

The present invention relates to the thermal flashing of carbonaceous materials. More specifically, the present invention relates to the thermal flashing of carbonaceous materials under conditions minimizing the destruction of flashed products.

Dwindling supplies of crude oil, particularly light oils containing small amounts of sulfur, nitrogen, metals and other contaminants, make it highly desirable that alternate sources of carbonaceous materials, such as oil shale, coals, lignites, tar sands, biomass and the like, heavier more highly contaminated crude oils and less desirable, normally solid fractions of crude oil be processed to produce more valuable liquid and gaseous fuels and feedstocks for production of chemicals and products thereof.

While some of the above-mentioned alternate sources of hydrocarbons, such as coal, lignite, biomass, etc. can be burned directly, such combustion is useful only for the production of heat, rather than more valuable products and, in most instances, the flue gases produced create serious pollution problems. Liquids of the nature of crude oil which can be processed to produce fuels and chemical feedstocks can be extracted from coal, lignite, oil shale and tar sands by solvent extraction. However, such solvent extraction is inefficient, and costly. In addition, direct burning of such oils is difficult and is subject to the same problems as burning the carbonaceous material directly, except that noncombustible solids have been removed. A large number of thermal processes have also been proposed for the production of liquids which can be upgraded to more valuable products, as well as directly useful fuels and chemical feedstocks. Such thermal processes are often classified as retorting when the source material contains substantial amounts of noncarbonaceous materials, such as oil shales and tar sands, or pyrolysis where the source material is relatively free of a noncarbonaceous material such as coal, lignite, normally solid hydrocarbons, biomass and the like. However, such terminology creates a distinction without substance since both involve the same physical and chemical transformations. Most widely researched and successful thermal techniques for the recovery of hydrocarbon materials from normally solid carbonaceous materials include strict thermal techniques to produce gases and liquids, the production of synthesis gas (about 50% hydrogen, 40% carbon monoxide, 3% carbon dioxide and 3% nitrogen) by heating in the presence of steam, generally referred to as steam reforming, heating in the presence of air and steam, generally referred to as the water gas reaction, and heating in the presence of hydrogen, generally referred to as hydropyrolysis or hydroretorting, to produce liquids and gases. Heat is supplied to such processes in one of four basic ways, namely, type I, in which heat is transferred through the wall of the vessel, type II, wherein a part of the carbonaceous material itself is burned in the reaction vessel, type III, wherein gases are heated externally of the reaction vessel, and type IV, wherein solids (often residual solids from the process itself) are heated externally of the reaction vessel. Such processes are also carried out in a variety of ways, including batch, semi-batch and continuous techniques as a fixed bed, a moving bed or fluidized bed and when contacting the solid material with a fluid either concurrent or countercurrent. All of these processes and the operating techniques generally involve the use of complex and expensive equipment, are complex multiple step techniques, are highly energy intensive and are over sensitive to variations in the conditions of operation. Additionally, substantial changes in technique and equipment are necessary in order to process different types of solid carbonaceous materials. Further, the generally utilized severe conditions of heat, pressure and/or residence time employed in such processes result in secondary decomposition in which liquids removed from the solid carbonaceous materials are decomposed to gaseous products suitable primarily for gaseous fuels and chemical feedstocks while sacrificing liquid products which can be burned directly or further processed into needed liquid fuels. While some of the more well developed processes of this character are close to being economically viable, are relatively efficient in removing extractable carbon and hydrogen and produce products requiring minimum further processing substantial improvements are still needed.

SUMMARY OF THE INVENTION

It is therefore an object of the present invention to provide an improved method for the recovery of valuable products from normally solid carbonaceous materials which overcome the above-mentioned and other problems of the prior art. Another and further object of the present invention is to provide an improved method for the recovery of valuable materials from normally solid carbonaceous materials wherein the economics are improved. Yet another object of the present invention is to provide an improved method for the recovery of valuable products from normally solid carbonaceous materials which efficiently recovers the carbon and hydrogen values of the carbonaceous material. Another object of the present invention is to provide an improved method for the recovery of valuable products from normally solid carbonaceous materials wherein the products are directly usable without further processing. Yet another object of the present invention is to provide an improved method for the recovery of valuable products from normally solid carbonaceous materials wherein the products are directly usable and in use, produce minimal pollution problems. A still further object of the present invention is to provide an improved process for the recovery of valuable products from normally solid carbonaceous materials wherein the energy requirements are reduced. Still another object of the present invention is to provide an improved process for the recovery of valuable products from normally solid carbonaceous materials which utilizes relatively simple equipment. Another and further object of the present invention is to provide an improved process for the recovery of valuable products from normally solid carbonaceous materials which can be utilized on a wide variety of such materials without major modifications of equipment or technique. Still another object of the present invention is to provide an improved process for the recovery of valuable products from normally solid carbonaceous materials which can be utilized on a wide variety of such materials without major modifications. Yet another object of the present invention is to provide an improved process for the recovery of valuable products from normally solid carbonaceous materials which requires relatively mild conditions. Another and further object of the present invention is to provide an improved process for the recovery of valuable products from normally solid carbonaceous materials wherein rapid and even mixing of such solids with fluids is attained. A further object of the present invention is to provide an improved thermal method for the recovery of valuable products from normally solid carbonaceous materials wherein rapid and even heating is attained. Another object of the present invention is to provide an improved process for the recovery of valuable products from normally solid carbonaceous materials wherein any or all of the above-mentioned objects and advantages are attained while maximizing the recovery of liquid products. These and other objects and advantages of the present invention will be apparent from the following description.

In accordance with the present invention, valuable products are obtained from particle-form, normally solid carbonaceous materials by contacting the carbonaceous material with a gas in a contact zone, maintaining a pressure within the contact zone near atmospheric pressure, heating the carbonaceous material in the contact zone, by heating the gas prior to use in the contact zone, externally heating the carbonaceous material in the contact zone or both, to a temperature sufficient to flash a maximum amount of gases and liquids therefrom, while at the same time minimizing decomposition of the thus flashed gases and liquids and maintaining the carbonaceous material in the contact zone for a residence time sufficient to thus maximize flashing of gases and liquids and minimize decomposition of such gases and liquids. In accordance with another aspect of the present invention, the gas utilized in the contact zone is introduced into a descending body of the carbonaceous material in an amount and at a pressure sufficient to entrain the carbonaceous material and produce a descending body of the entrained carbonaceous material in an elongated contact zone while maintaining a pressure within the contact zone near atmospheric pressure.

DESCRIPTION OF THE PREFERRED EMBODIMENTS

Figure 1:
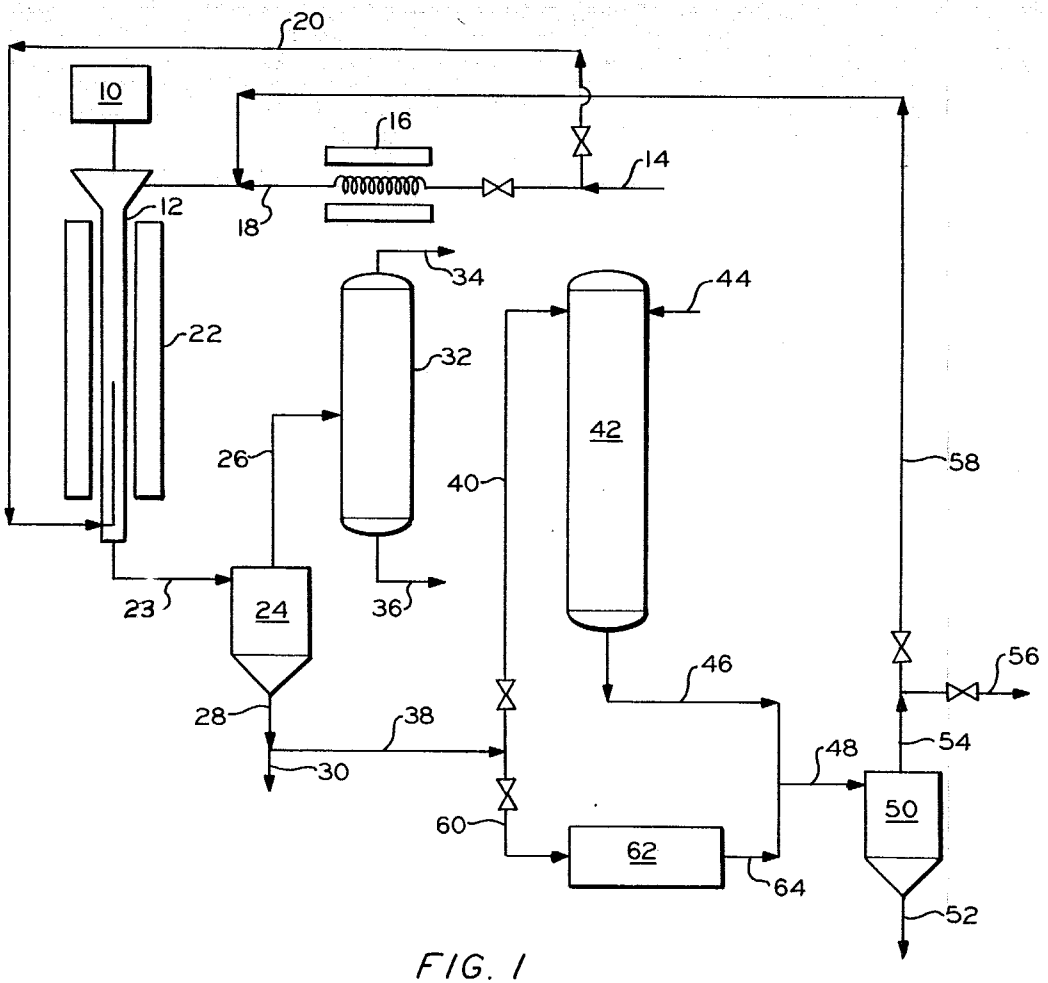
FIG. 1 is a schematic flow diagram illustrating the process of the present invention.

The present invention is applicable to the thermal flashing of gases and liquids from any normally solid carbonaceous material. Such normally carbonaceous solid materials include coals, lignites, oil shales, tar sands, asphalts, bitumens and tars from various sources, shale oils, coal oils, tar sand oils, heavy residual fractions from petroleum, shale oils, coal oils, tar sand oils, biomass and like materials, provided only that the material is normally solid and can be ground to a suitable particle size.

The normally solid feed material is generally ground to a size that can be effectively contacted with a gas and a substantial portion of gases and liquids can be flashed therefrom in a short period of time. Preferably, in accordance with one embodiment of the invention, the particle size is such that the normally solid feed can be entrained in a moving stream of gas at essentially atmospheric pressure. Specifically, a suitable particle size for this purpose is from about −140 mesh to +170 mesh and preferably −100 mesh to +170 mesh.

The temperature employed will depend on the normally solid carbonaceous material utilized. Accordingly, the temperature should be sufficiently high to flash a maximum amount of gases and liquids from the normally solid carbonaceous material but sufficiently low to minimize decomposition of the thus flashed gases and liquids. As a general proposition, the temperature should be above about 750° F. and below about 1500° F. Preferably, the temperature should be between about 1050° F. and 1300° F. and still more preferably between 1050° F. and 1160° F. In accordance with one aspect of the present invention, at least a part of, and preferably all of, the heat is supplied to the normally solid carbonaceous material by contacting the carbonaceous material with a hot gas which has been heated prior to contacting the same with the carbonaceous material. In accordance with another aspect of the present invention, wherein a carrier gas is utilized to entrain the carbonaceous material and produce a descending body of the entrained carbonaceous material in the contact zone, heat is supplied to the carbonaceous material by heating the carrier gas prior to contact with the carbonaceous material, heating the carbonaceous material itself, or both.

The pressure at which the carbonaceous material is contacted with the carrier gas or the hot gas is near atmospheric pressure. In most cases, however, prior to contact with the carbonaceous material, the gas will be at a slightly elevated pressure so that the gas will pass through the carbonaceous material or, where the gas entrains the carbonaceous material to form an entrained descending body of carbonaceous material, the gas will be at a slightly higher pressure for example about 300 psi, which is sufficient to entrain the carbonaceous material and flow downwardly through the contact zone. Irrespective of the pressure necessary to attain contact between the carbonaceous material and the gas or entrain the carbonaceous material, the average pressure within the contact zone itself will be near atmospheric pressure.

The residence time also should be sufficiently long to maximize the flashing of gases and liquids from the carbonaceous material but less than a residence time at which significant decomposition of the thus flashed gases and liquids occurs. In general, the residence time should be below about 1000 milliseconds, preferably between about 10 and about 500 milliseconds and still more preferably between about 50 and 150 milliseconds.

The gas, whether it be utilized as a source of heat or as a carrier for entraining a descending body of the carbonaceous material, may be any suitable inert or reactive gas. For example, inert gases include helium, nitrogen, carbon dioxide, flue gases (80% nitrogen, 20% carbon dioxide), preferably from burning at least a part of the residual solids containing unflashed carbonaceous materials, etc. Reactive gases may include synthesis gases, which will normally comprise about 40% carbon monoxide, 50% hydrogen, 3% carbon dioxide and 3% nitrogen and which can be obtained by steam reforming a carbonaceous material with steam or partial oxidation of a carbonaceous material with steam and oxygen by the water-gas reaction, preferably by utilizing at least a part of the residual solid material containing unflashed carbonaceous materials from the reaction itself. Any of the reactive gases may also be utilized alone or in various combinations, for example hydrogen, steam, carbon monoxide, hydrogen plus steam, carbon monoxide plus steam, hydrogen with water vapor, carbon monoxide with water vapor, etc. However, where reactive gases are utilized, particularly combustion supporting gases, the conditions of operation are maintained such that no significant combustion or destruction of the flashed gases and liquids, particularly liquids, will occur. Where the gas is utilized to supply at least part of the heat to the contact zone, the gas is preheated by means of a suitable furnace or heater or in those cases in which at least part of the residual solids are utilized to produce a synthesis gas or a flue gas, the hot gas resulting from such operations is utilized directly after removal of solids therefrom. In some cases, it may be necessary to reduce the temperature and/or pressure of the latter gases before passing the same to the contact zone.

The method of carrying out the present invention can be best illustrated by reference to the description when read in conjunction with the drawings.

In accordance with FIG. 1, suitably ground carbonaceous material is supplied from a feeder 10. The feeder may, for example, be a star wheel rotated by a "Magnedrive" power source (manufactured by Autoclave Engineers) which is capable of feeding solids at an elevated pressure. The use of such a drive mechanism eliminates any need for a mechanical seal to prevent gas leakage around the rotating star wheel shaft. The feed rate may be controlled by controlling the rpm of the motor utilized to rotate the drive. However by operating in accordance with the present invention, i.e., at essentially atmospheric pressure within the reactor, the usual elaborate feed means and seal means necessary for high pressure operation are eliminated, thus greatly reducing the cost of equipment and the difficulties encountered in feeding solids to a high pressure reactor. The carbonaceous solid is fed to reactor 12, which is schematically illustrated and will be described in detail with respect to FIGS. 2 through 4. A gas, such as one or more of those suggested previously, is introduced from an external source through line 14. Where the gas introduced through line 14 is to be utilized to supply all or part of the heat to reactor 12, the gas is passed through a suitable furnace or heater 16 where it is heated to an appropriate temperature and thence through line 18 to reactor 12. A suitable temperature for this gas, in accordance with the present invention, is about 2000° F. With the gas at this temperature prior to introduction, the nominal temperature within the reactor will be between about 1100° and 1300° F. The gas from line 18 is intimately mixed with the solid carbonaceous material from feeder 10 at the top of reactor 12 and as a result of such intimate mixing, heating of the carbonaceous material and flashing of gases and liquids therefrom begins almost instantaneously. In the embodiment illustrated, the gas also entrains the carbonaceous material and the carbonaceous material then passes downwardly through reactor 12 as an entrained descending body of material. After an appropriate residence time within reactor 12, at which maximum flashing of gases and liquids from the carbonaceous material is attained but before a significant decomposition of the flashed gases and liquids, the reaction mixture is quenched, for example, by circulating an unheated portion of the gas from line 14 through line 20 to a point near the bottom of the reactor 12. Such cooling also must take place rapidly and, for example, reduces the temperature to about 600° F. At this temperature, the liquids are still in a vapor form or at the very least are in a form such as they will be carried along with the carrier gas and the gases produced in the reactor. To the extent that it is more convenient, economical or necessary, heat may also be supplied by means of heater 22 surrounding the reactor 12. The total effluent from reactor 12, comprising carrier gas, flashed gases and flashed liquids, passes through line 23 to an appropriate separator 24, which in the present case is a cyclone-type separator. In separator 24, the flashed gases and the flashed liquids in their vapor state are separated and discharged through line 26 and residual solids, containing some unflashed carbonaceous material, is discharged through line 28. Where the feed material is substantially all carbonaceous material, which does not contain inert solids, such as sand or rock from tar sands or shales, the residual solids separated and passed through line 28 can be utilized for a number of purposes as for adsorption, etc. Consequently, all or part of the material may be withdrawn through line 30. For example, where coal or lignite is utilized, the pore volume and surface area of the char particles increase by a factor of 50% to 100% over the pore volume and surface area of the original feed. This enhancement of the pore volume and surface area makes it suitable for use as an adsorbent or, because of the presence of sufficient volatile materials, is ideal for combustion or gasification to produce a synthesis gas. The gases and vapors passed through line 26 can be appropriately separated into a gaseous fraction and a liquid fraction by passing the same to a knockout pot or condensor and separator 32. The gaseous product is withdrawn through line 34. Generally this product will contain methane, ethane, significant amounts of ethylene, hydrogen, carbon monoxide and some small amounts of carbon dioxide and, if the carrier gas is an inert gas, also the carrier gas. These gases can be separated and utilized for their known purposes. Liquids, separated in separator 32, are withdrawn through line 36. This liquid will normally be of the nature of a middle distillate. More importantly, for example where lignite is utilized as a feed material, the liquid contains substantially less sulfur, nitrogen and oxygen than the feed materials. In addition, the hydrogen to carbon ratio is in the neighborhood of about 1.4, the API gravity about 2.6 to −2.7 and the viscosity of about 16,000 centipoise at 50° C. This liquid can therefore be separated into a gasoline boiling range fraction. A naptha boiling range fraction and a gas-oil fraction, if desired. Also, the liquids from lignite feeds can be used as a boiler fuel without further upgrading. For example, the sulfur content may range between 0.61 and 0.65 percent and, as such, it is possible to meet EPA New Source standards for emissions without further treatment. Rather than utilize the residual solid material as a product or to dispose of the same if it is not usable, a preferred embodiment utilizes part or all of the residual solids as a source of hot carrier gas. Specifically, the residual solid material is passed through line 38 and thence through line 40 to an appropriate gasifier 42. Gasifier 42 is supplied with water or steam or a mixture of water or steam with oxygen through line 44. Gasifier 42 is maintained at a temperature above about 2000° F. at a pressure of about one atmosphere to thereby produce a suitable synthesis gas comprising carbon monoxide and hydrogen with small amounts of $CO_2$ and nitrogen, if air is utilized as an oxidizing agent. The effluent from gasifier 42 is then passed through line 46 and line 48 to an appropriate solids separator, which in the present case is shown as cyclone separator 50. Separator 50 separates solids materials from the synthesis gas and discharges the solids materials through line 52 for disposal. Where the carbonaceous feed is essentially all carbonaceous material, solids will generally be most of the metal content of the feed material, for example, nickel and vanadium. Where the feed material contains inert components such as sand, etc., the sand as well as the original metals of the feed will be discharged, but in most cases will contain little or no carbonaceous material and, therefore, may be disposed of. Synthesis gas separated in separator 50 is discharged through line 54. All or part of this gas may be utilized for known purposes as a synthesis gas by withdrawing the same through line 56. However, the desirable operation will involve utilizing part or all of the synthesis gas as a hot carrier gas for carrying out the thermal flashing reaction. For this purpose the gas is passed through line 58. Since, as previously indicated, the desirable gas temperature to the reactor 12 is about 2000° F., the synthesis gas passing through line 58 needs no further heating or moderation of the heat. A further alternative in accordance with the present invention is to utilize all or part of the residual solids passing through line 38 as fuel for a combustor. Specifically, residual solids passing through line 38 will be passed through line 60 to an appropriate burner or combustor 62. Combustor 62 may be utilized to supply heat for in plant use or to generate steam for in plant use. In addition, the flue gas can be utilized as a source of hot carrier gas. In this instance, all or part of the flue gas is passed through line 64 and thence through line 48 to separator 50. In separator 50 solids are removed and discharged through line 52 and the flue gas comprising about 80% nitrogen and 20% carbon dioxide is passed through lines 54 and 58 to the reactor 12.

In accordance with one embodiment of the invention, the hot gas, utilized as a source of heat for thermal flashing can be contacted with the carbonaceous material in any other form than that illustrated in FIG. 1. For example, the feed may be passed downwardly through the reactor 12, while the gas is passed countercurrently upwardly through the reactor. However, the preferred embodiment of the present invention comprises the entrained flow contactor illustrated in FIGS. 2 through 4.

Figure 2:
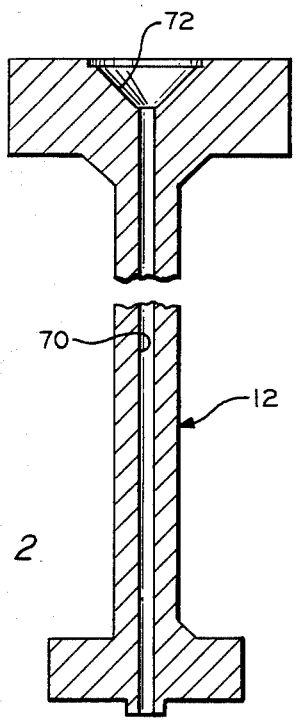

In accordance with FIG. 2, the contactor 12 is basically a vertically disposed elongated tube provided with a central bore 70. A flared receiving section 72 is provided at the top of the central bore 70 for receiving and mixing carbonaceous material and carrier gas. As indicated hereinafter, intimate mixing of the carbonaceous material and carrier gas takes place in the flared cavity 72, thus resulting in substantially instantaneous heating and flashing of gases and liquids from the carbonaceous material which proceeds as the carbonaceous material entrained in the carrier gas passes downwardly through tubular section 70. The carrier gas introduced through line 14, if not already heated, passes through heating coil 74 and the heated gas then passes through line 18 as indicated in FIG. 1. From line 18, the carrier gas passes to a distributor 76. In distributor 76 the carrier gas is split into two equal portions which pass through lines 78 and 80, respectively. The portion of the carrier gas passing through line 78 then passes to another distributor means 82, which further splits the gas into two equal portions which are passed through lines 84 and 86, respectively. The portion of the gas passing through line 80 is similarly passed to a distributor means 88 and is split into two equal portions which are passed through lines 90 and 92, respectively. The carrier gas, passing through lines 84, 86, 90 and 92, is thus introduced radially into the cavity 72 at the top of reactor 12 where it contacts a downflowing carbonaceous material and intimately mixes with the carbonaceous material. As is obvious from the figure, the portions of the carrier gas are introduced at equally spaced positions around the top of the reactor 12 to thus provide radial opposing jets of gas which aid in the mixing of the gas with the solid carbonaceous material. Obviously more than four gas introduction means could be utilized, provided only that radially disposed jets of the gas oppose one another and are equally spaced around the top of the reactor. The feeder 10 (FIG. 1) can obviously be directly attached to the top of contactor 12. In addition, contactor 12, as well as distributor means 76 can be provided with appropriately distributed thermocouples or the like to measure the temperatures as desired.

As previously indicated, by operating at essentially atmospheric pressure in accordance with the present invention, the feeder and seal system can be greatly simplified and thus reduced in cost and numerous problems of operation can also be eliminated. The same applies to the reactor system itself. Specifically, the reactor 12 need not be a high pressure tube or vessel, thus reducing the cost and complexity of the reactor itself. In addition, in accordance with the present invention, a single simple contactor 12 can be utilized, as opposed to the complex, expensive and difficult to control multiple fluidized bed devices heretofore utilized in the prior art. By utilizing the simplified contacting as carried out in reactor 12 and in accordance with the present invention, in combination with a gasifier and/or a combustor to supply hot carrier gas, substantial savings can be realized over prior art systems utilizing gasifiers and/or combustors alone.

The following examples illustrate the operation of the present invention and the results obtainable thereby.

In order to quickly establish the workability of the present invention, a small scale laboratory reactor system was set up. This system comprised a two-foot long stainless steel tube having a ⅛" inside diameter and a thermocouple welded to the tube near the middle. The tube was electrically heated and provision was made to pass helium therethrough. A small sample (about 100 milligrams) of pulverized carbonaceous material was deposited on the inside of the tube near the middle by placing the sample in the tube, together with a solvent rotating the tube to distribute the solid around the tube wall, plugging the ends with glass wool plugs and finally evaporating the solvent by flowing helium therethrough. A preselected flow of helium was established therough the tube at room temperature while venting the gas. When steady state flow was achieved, the tube was rapidly heated by electrical means to the desired temperature for the desired period of time. Thereafter, heating was discontinued and the reactor rapidly cooled by flowing nitrogen around the reactor. The reaction product from the reactor was rapidly quenched to room temperature. Heavy condensed liquid formed in the walls of the cooling unit and the product gas was collected in a collection tank. Since the amount of oil deposited in the cooling unit was extremely small, no attempt was made to recover the same. Total conversion was determined by the difference in weight of the sample before and after treatment. The gas yield was determined from a gas analysis and the pressure, temperature, volume relationship in the gas collection vessel.

A bottoms fraction obtained from Monagas crude from Venzuela, which is produced by super critical extraction of the crude to produce an extract low in metals and sulfur and having a higher API than the feed, thus leaving a bottoms fraction of about 10% to 15% of the crude. The samples utilized as a test had a composition of about 84.1 wt.% carbon, 8.6 wt.% hydrogen, 4.34 wt.% sulfur, 1.26 wt.% nitrogen, 193 ppm of nickel and 1420 ppm vanadium. Ramsbottom Carbon was 40.2 wt.% and the melting point above 300° F.

A series of tests was carried out with helium at an average pressure of about one atmosphere, gas residence time of about 21–31 milliseconds and temperatures between about 1084° F. and 1001° F. The ground sample was −140 mesh. Total conversions between about 18.3 and 41.0 wt.% of the original sample were obtained. Of the total conversion, gas yields were about 5.6 to 7.5 wt.% and liquid yields (by difference) about 25.8 to 28.2%.

A lignite having 23.64 wt.% ash and 3.32 wt.% moisture and a fixed carbon content of 35.88% was similarly ground to −140 mesh and a series of tests were conducted on this material. In this series of tests, temperatures between about 859° F. and 1239° F. and residence times between 80 and 110 milliseconds were utilized and helium at atmospheric pressure was utilized as a carrier gas.

Total conversions ranged between about 9 wt.% and 34.1 wt.% with the majority above about 20%.

A typical gas analysis comprises 43.2% methane, 18.3% ethane, 12.4% ethylene, 4.9% propylene, 7.0% butane, 3.4% pentane and small amounts of benzene and toluene.

Figure 4:
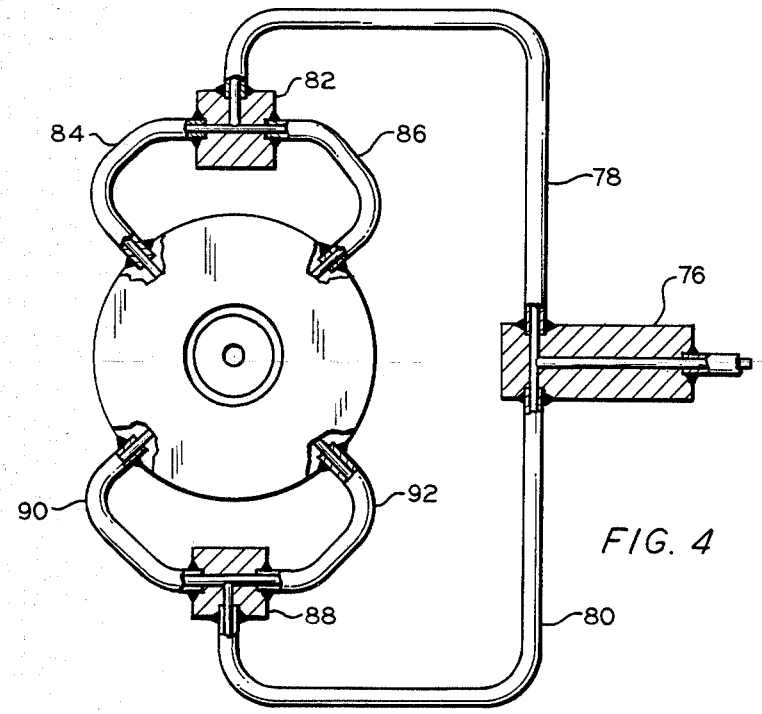
FIGS. 2, 3 and 4 are side and top views, partially in section, of contacting apparatus, together with appurtenant gas feed apparatus suitable for use in carrying out one embodiment of the present invention.
Figure 3:
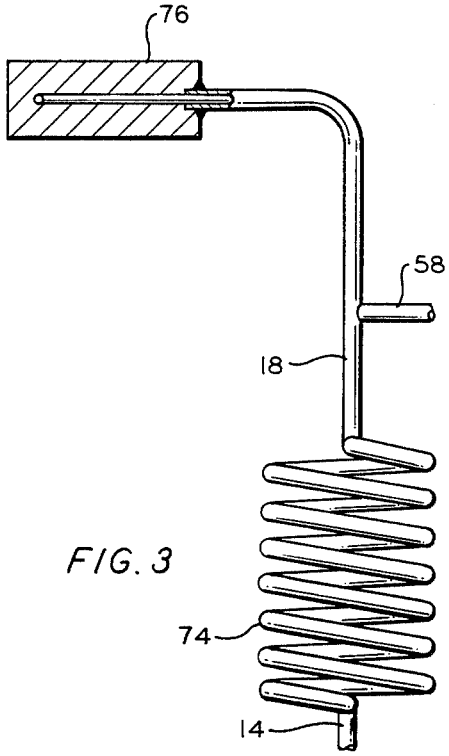

Another series of tests were conducted in a bench scale unit, constructed as illustrated in FIGS. 2 through 4 of the drawings. The contact tube was 64 inches long and had an internal diameter of one-fourth inch. In the conduct of this series of experiments, the ground carbonaceous material was fed to the top of the contactor by means of the previously described solids feeder. Typically, experiments are carried out continuously for two to three hour periods with a feed rate of approximately 40 to 70 grams per hour. Helium heated to a temperature above the desired reaction temperature was utilized as a carrier gas and helium at ambient temperature was utilized as a quench near the contact tube exit. Effluent from the reactor was collected in a char pot connected to the bottom of the reactor. The mixture of product gas, liquid vapor and carrier gas was passed through a sand filter to collect residual char particles. Thereafter, the mixture of gases and vapors was passed through a series of three knockout pots filled with glass balls and cooled in an ice water-salt bath to condense the liquids. A fourth knockout pot was cooled with dry ice and trichloroethane in order to condense water which was not condensed in the previous knockout pots. The noncondensable mixture was allowed to flow continuously through gas sample bombs and then to a flare line. Every ten to fifteen minutes the bombs were isolated for sampling. Char collected in the char pot was weighed, residual char in the sand filter was determined by difference in weight before and after the run and unconverted carbonaceous material in the reactor was also collected. Liquid product was separated by washing the glass packing in the four knockout pots in a solvent, such as trichoroethane. All but a trace of said solvent was then separated in a Rotavapor (Trademark Buchi Labs Technik AG, Flawil, Switzerland) rotary evaporator. The remaining liquid product was maintained in an oven at 140° F., with a small flow of helium therethrough, until any water and the trace of solvent was removed and a constant weight was achieved. Gas production was obtained by a difference between the weight of the total char, the unreacted carbonaceous material and the total liquids and the original sample weight.

Three samples of lignite ground to −100 to +170 mesh and having the compositions listed in Table I below were utilized in this series of tests.

TABLE I

Comparison of Lignites from Different Seams

| Daf-basis, wt. % | Panther Hill (Texas) | Antioch (Mississippi) | Henning (Tennessee) |
|---|---|---|---|
| Volatile | 50.3 | 63.8 | 66.4 |
| Fixed Carbon | 49.7 | 36.2 | 33.9 |
| Carbon | 70.0 | 71.6 | 72.6 |
| Hydrogen | 5.4 | 7.0 | 6.9 |
| Nitrogen | 1.51 | 0.90 | 0.68 |
| Sulfur | 1.27 | 1.83 | 2.05 |
| Oxygen (difference) | 20.7 | 18.7 | 17.8 |
| H/C | 0.92 | 1.17 | 1.14 |
| Ash (dry-basis) | 25.5 | 11.2 | 11.1 |

Temperatures in the series of runs averaged about 1150° F. and hot helium was utilized as the carrier gas. Pressure within the contact was about one atmosphere. Residence times for the Panther Hill lignite would vary between about 30 and about 140 milliseconds whereas the residence times for the other two lignites was between about 80 and about 140 milliseconds. Total conversions as high as about 29 to 32 percent by weight for Panther Hill, 40 to about 47 for the Antioch and about 48 to about 52 for the Henning, all on a dry ash free basis, were obtained. Liquid yields for these runs were about 9% for Panther Hill, 11% to 12% for Antioch and 20% to about 25% for the Henning lignite.

Average molecular weights of the liquids was in the neighborhood of about 333 to 372. Typical compositions of liquid products are set forth in Table II below.

TABLE II

Comparison of Lignite Liquids

| | Panther Hill wt. % | Antioch wt. % | Henning wt. % |
|---|---|---|---|
| C | 81.20 | 78.32 | 78.98 |
| H | 9.10 | 9.30 | 9.94 |
| N | 1.04 | 0.55 | 0.44 |
| S | 0.65 | 0.61 | 0.63 |
| O | 8.00 | 11.22 | 8.50 |
| H/C | 1.33 | 1.42 | 1.50 |

Typical compositions of the gas products are shown in Table III below.

TABLE III

Composition of Gas

| | Henning Lignite % | Antioch Lignite % |
|---|---|---|
| $H_2$ | 15.0 | NA |
| $CH_4$ | 18.3 | 9.2 |
| CO | 3.1 | Small |
| $CO_2$ | 29.4 | 54.3 |
| $C_2 + C_2{=}$ | 19.6 | 22.6 |
| $C_3$ | 4.7 | 2.4 |
| $C_3{=}$ | NA | 6.4 |
| $C_4$ | 4.4 | 3.3 |

TABLE III-continued

| | Composition of Gas | |
|---|---|---|
| | Henning Lignite % | Antioch Lignite % |
| $C_5$ | 1.0 | 1.5 |
| $C_6^+$* | NA | 3.7 |

*Includes aromatics

Typical char properties are shown in Table IV below.

TABLE IV

Surface Area and Pore Volume of Lignite and Char

| | Panther Hill | | Antioch | | Henning | |
|---|---|---|---|---|---|---|
| | Lignite | Char | Lignite | Char | Lignite | Char |
| Surface area,* $M_2$/gm | 5.7 | 10.7 | 3.8 | 13.1 | 5.6 | 8.1 |
| Pore Volume** cc./gm | 0.15 | 0.26 | 0.26 | 0.45 | 0.39 | 0.63 |

*BET, $N_2$ surface area
**Determined by mercury porosimetry

While specific materials, equipment and modes of operation are set forth herein, it is to be understood that these specific recitals are by way of illustration and to set forth the best mode in accordance with the present invention and are not to be considered limiting.

That which is claimed:

1. A method for flashing liquids and gases from a particle-form, normally solid, carbonaceous material, comprising:
   (a) introducing a carrier gas into a descending body of said carbonaceous materials in an amount and at a pressure sufficient to entrain said carbonaceous material and produce a descending body of the thus entrained carbonaceous material in an elongated flashing zone at a pressure of about atmospheric pressure;
   (b) heating at least one of (1) said carrier gas prior to introduction into said carbonaceous material and (2) said descending body of entrained carbonaceous material to a temperature, between about 800° F. and about 1500° F., sufficient to flash a maximum amount of gases and liquids therefrom and minimize decomposition of the thus flashed gases and liquids; and
   (c) maintaining said carbonaceous material in said flashing zone for a residence time, between about 40 and about 500 milliseconds, sufficient to thus maximize flashing of said gases and liquids and thus minimize decomposition of said flashed gases and liquids.

2. A method in accordance with claim 1 wherein the temperature is reduced to a temperature below about 600° F. adjacent to the bottom of the flashing zone.

3. A method in accordance with claim 1 wherein the temperature within the flashing zone is between about 1050° F. and about 1300° F.

4. A method in accordance with claim 3 wherein the temperature is reduced to a temperature below about 600° F. adjacent to the bottom of the flashing zone.

5. A method in accordance with claim 3 wherein the residence time within the flashing zone is between about 50 and 150 milliseconds.

6. A method in accordance with claim 1 wherein the effluent from the flashing zone is separated into a gaseous and vapor phase and a residual solids phase, containing unflashed carbonaceous materials, said residual solids are subjected to steam reforming to produce a synthesis gas and at least a part of said synthesis gas is utilized as at least a part of said carrier gas.

7. A method in accordance with claim 6 wherein the synthesis gas is produced by the water gas reaction.

8. A method in accordance with claim 1 wherein the effluent from the flashing zone is separated into a gaseous and vapor phase and a residual solids phase, containing unflashed carbonaceous materials, said residual solids are subjected to combustion to produce a flue gas, and at least a part of said flue gas is utilized as at least a part of the carrier gas.

9. A method in accordance with claim 1 wherein the carrier gas is an inert gas.

10. A method for flashing liquids and gases from a particle-form, normally solid, carbonaceous material, comprising:
   (a) contacting said carbonaceous material with a gas in a flashing zone;
   (b) maintaining a pressure of about atmospheric pressure in said flashing zone;
   (c) heating said carbonaceous material in said flashing zone, at least in part, by heating said gas prior to thus contacting said carbonaceous material with said gas, to a temperature, between about 800° F. and about 1500° F., sufficient to flash a maximum amount of gases and liquids therefrom and minimize decomposition of the thus flashed gases and liquids; and
   (d) maintaining said carbonaceous material in said flashing zone for a residence time, between above 40 and about 500 milliseconds, sufficient to thus maximize flashing of said gases and liquids and thus minimize decomposition of said flashed gases and liquids.

11. A method in accordance with claim 10 wherein the temperature is reduced to a temperature below about 600° F. adjacent to the bottom of the flashing zone.

12. A method in accordance with claim 10 wherein the temperature within the flashing zone is between about 1050° F. and about 1300° F.

13. A method in accordance with claim 12 wherein the temperature is reduced to a temperature below about 600° F. adjacent the bottom of the flashing zone.

14. A method in accordance with claim 12 wherein the residence time within the flashing zone is between about 50 and about 150 milliseconds.

15. A method in accordance with claim 10 wherein the effluent from the flashing zone is separated into a gaseous and a vaporous phase and a residual solids phase, containing unflashed carbonaceous material, said residual solids are subjected to steam reforming to produce a synthesis gas and at least a part of said synthesis gas is used as at least a part of the carrier gas.

16. A method in accordance with claim 10 wherein the effluent from the flashing zone is separated into a gaseous and a vapor phase and a residual solids phase, containing unflashed carbonaceous materials, said residual solids are subjected to combustion to produce a flue gas and at least a part of said flue gas is utilized as at least a part of the carrier gas.

17. A method in accordance with claim 10 wherein the carrier gas in an inert gas.

* * * * *